US011089850B1

(12) United States Patent
Liu

(10) Patent No.: US 11,089,850 B1
(45) Date of Patent: Aug. 17, 2021

(54) MAGNETIC FLOATING DECORATIVE DEVICES

(71) Applicant: Wyna Liu, New York, NY (US)

(72) Inventor: Wyna Liu, New York, NY (US)

( * ) Notice: Subject to any disclaimer, the term of this patent is extended or adjusted under 35 U.S.C. 154(b) by 374 days.

(21) Appl. No.: 16/331,959

(22) PCT Filed: Sep. 10, 2017

(86) PCT No.: PCT/US2017/050863

§ 371 (c)(1),
(2) Date: Mar. 8, 2019

(87) PCT Pub. No.: WO2019/050539

PCT Pub. Date: Mar. 14, 2019

(51) Int. Cl.

| | |
|---|---|
| ***A44C 15/00*** | (2006.01) |
| ***A44C 25/00*** | (2006.01) |
| ***A44C 11/00*** | (2006.01) |
| ***A44C 5/00*** | (2006.01) |
| ***A44C 9/00*** | (2006.01) |
| ***A44C 7/00*** | (2006.01) |

(52) U.S. Cl.
CPC ..... *A44C 11/00* (2013.01); *A44C 5/0061* (2013.01); *A44C 7/00* (2013.01); *A44C 9/0053* (2013.01); *A44C 15/00* (2013.01); *A44C 25/001* (2013.01); *A44D 2203/00* (2013.01)

(58) Field of Classification Search
CPC ..... A44C 11/00; A44C 5/0061; A44C 7/00; A44C 9/0053; A44C 15/00; A44C 25/001; A44C 9/00; A44C 17/02; A44C 25/007; A44C 25/008; A44D 2203/00
See application file for complete search history.

(56) References Cited

U.S. PATENT DOCUMENTS 2,220,049 A * 10/1940 Dunmore ..... G09F 11/23 40/426
2,702,191 A * 2/1955 Lemelson ..... F41J 7/04 273/393
3,955,315 A * 5/1976 Goodman ..... A63H 33/26 446/133
4,250,659 A * 2/1981 Ishiguro ..... A63H 13/12 273/456

(Continued)

FOREIGN PATENT DOCUMENTS

DE 2711817 A1 * 9/1978 ..... A44C 15/00

*Primary Examiner* — Jack W Lavinder
(74) *Attorney, Agent, or Firm* — Roy L. Chan, A Professional Law Corporation; Roy L. Chan

(57) ABSTRACT

Disclosed is a magnetic floating decorative device comprising: a body; and, a floating section. The body comprises a ferromagnetic-body section. The floating section comprises a ferromagnetic-floating section. The floating section is flexible. The floating section is connected to the body at a connection point. The ferromagnetic-body section is magnetically attracted to the ferromagnetic-floating section. Another embodiment of the present invention is a magnetic floating decorative device comprising: a body; and, a floating section. The floating section comprises a first ferromagnetic-floating section and a second ferromagnetic-floating section. The floating section is flexible. The floating section is connected to the body at a connection point. The first ferromagnetic-floating section is magnetically attracted to the second ferromagnetic-floating section.

27 Claims, 10 Drawing Sheets

(56) References Cited

U.S. PATENT DOCUMENTS

| | | | | | |
|---|---|---|---|---|---|
| 4,690,657 | A * | 9/1987 | Lodrick, Sr. | A63H 33/26 | 273/141 A |
| 5,052,968 | A * | 10/1991 | Lodrick, Sr. | A63F 9/34 | 446/134 |
| 5,589,721 | A * | 12/1996 | Han | G09F 9/375 | 310/90.5 |
| 2013/0232729 | A1 * | 9/2013 | Abadi | A44B 6/00 | 24/66.4 |

* cited by examiner

MAGNETIC FLOATING DECORATIVE DEVICES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention is related to novel decorative devices that uses magnetism to create suspended floating apparatus that may be worn (such as jewelry) or not worn (such as sculptures).

BRIEF SUMMARY OF THE INVENTION

An embodiment of the present inventions is a magnetic floating decorative device comprising: a body; and, a floating section. The body comprises a ferromagnetic-body section. The floating section comprises a ferromagnetic-floating section. The floating section is flexible. The floating section is connected to the body at a connection point. The ferromagnetic-body section is magnetically attracted to the ferromagnetic-floating section.

In another embodiment of the present invention, the magnetic floating decorative device is a decorative apparatus selected from wearable decorative devices and non-wearable decorative devices. The wearable decorative devices are jewelry selected from the group consisting of earrings, pendants, rings, bracelets, sarpeches, hatpins, hairpins, headpieces, carcanets, necklaces, armlets, cufflinks, hand chains, belly chains, brooches, chatelaines, and anklets.

In yet another embodiment of the present invention, the ferromagnetic-body section is magnetized.

In another embodiment of the present invention, the ferromagnetic-floating section is magnetized.

In yet another embodiment of the present invention, the ferromagnetic-body section is magnetized; and, the ferromagnetic-floating section is magnetized.

Another embodiment of the present invention is a magnetic floating decorative device comprising: a body; and, a floating section. The floating section comprises a first ferromagnetic-floating section and a second ferromagnetic-floating section. The floating section is flexible. The floating section is connected to the body at a connection point. The first ferromagnetic-floating section is magnetically attracted to the second ferromagnetic-floating section.

In yet another embodiment of the present invention, the first ferromagnetic-floating section is magnetized.

In another embodiment of the present invention, the first ferromagnetic-floating section is magnetized; and, the second ferromagnetic-floating section is magnetized.

In yet another embodiment of the present invention, the jewelry is an earring.

In another embodiment of the present invention, the jewelry is a pendant.

In yet another embodiment of the present invention, the jewelry is a ring.

In another embodiment of the present invention, the jewelry is a bracelet.

In yet another embodiment of the present invention, the non-wearable decorative device is a sculpture.

BRIEF DESCRIPTION OF THE SEVERAL VIEWS OF THE DRAWING

The advantages and features of the present invention will be better understood as the following description is read in conjunction with the accompanying drawings, wherein.

DETAILED DESCRIPTION OF THE INVENTION

Figure 1C:
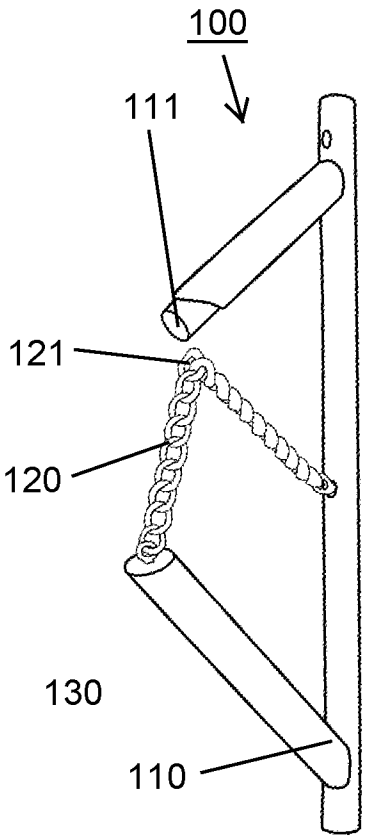
FIGS. 1A-1C are perspective views of embodiments of the present invention.
Figure 1B:
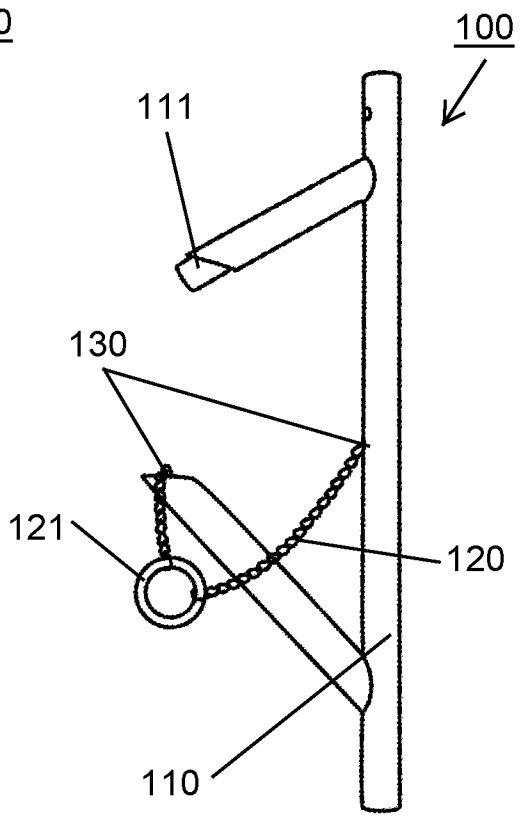

The figures disclose embodiments of a magnetic floating decorative device 100, 200, 300, 400, 500 comprising a body 110 and a floating section 120. The body 110 comprises a ferromagnetic-body section 111 and the floating section 120 comprises a ferromagnetic-floating section 121, as shown in FIGS. 1A-1C, 2A-2C, 3A-3B, 4A-4B, 5A-5C, 6A-6B, 7A-7B, 8A-8D, and 9. The floating section 120 is flexible. The floating section 120 also is connected to the body 110 at a connection point 130. In some embodiments, the floating section 120 may be connected to the body 110 at two or more connection points 130. The ferromagnetic-body section 111 is magnetically attracted to the ferromagnetic-floating section 121.

In some embodiments, the ferromagnetic-body section 111 is magnetized. In other embodiments, the ferromagnetic-floating section 121 is magnetized. In other embodiments, both the ferromagnetic-body section 111 and the ferromagnetic-floating section 121 are magnetized. For example, for the pendant 100 illustrated in FIG. 3A, in one embodiment, the ferromagnetic-body section 111 is magnetized, while the two ferromagnetic-floating sections 121 are not magnetized; in a second embodiment, the ferromagnetic-body section 111 is not magnetized, while the two ferromagnetic-floating sections 121 are magnetized; and, in a third embodiment, the ferromagnetic-body section 111 and the two ferromagnetic-floating sections 121 are magnetized. Similarly, for the pendant 100 shown in FIG. 5A, in one embodiment, the ferromagnetic-body section 111 is magnetized, while the ferromagnetic-floating section 121 is not magnetized; in a second embodiment, the ferromagnetic-body section 111 is not magnetized, while the ferromagnetic-floating section 121 is magnetized; and, in a third embodiment, the ferromagnetic-body section 111 and the ferromagnetic-floating section 121 are magnetized.

Figure 10A:
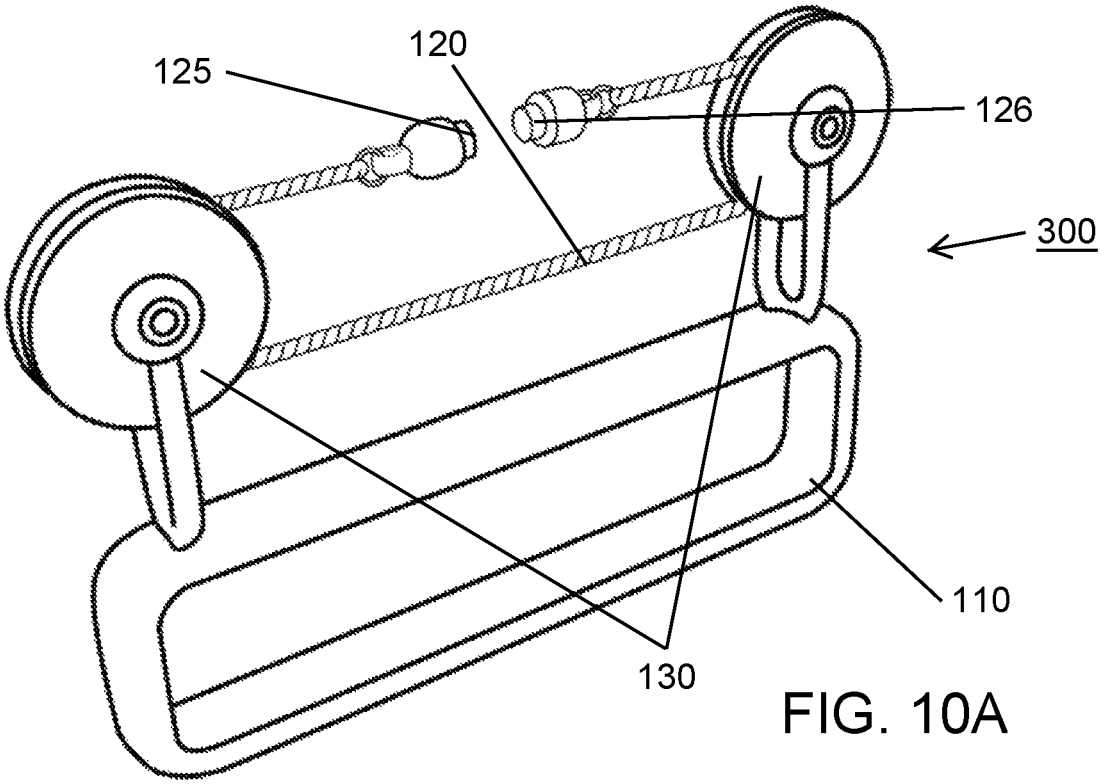
FIGS. 10A-10B are perspective views of embodiments of the present invention.
Figure 10B:
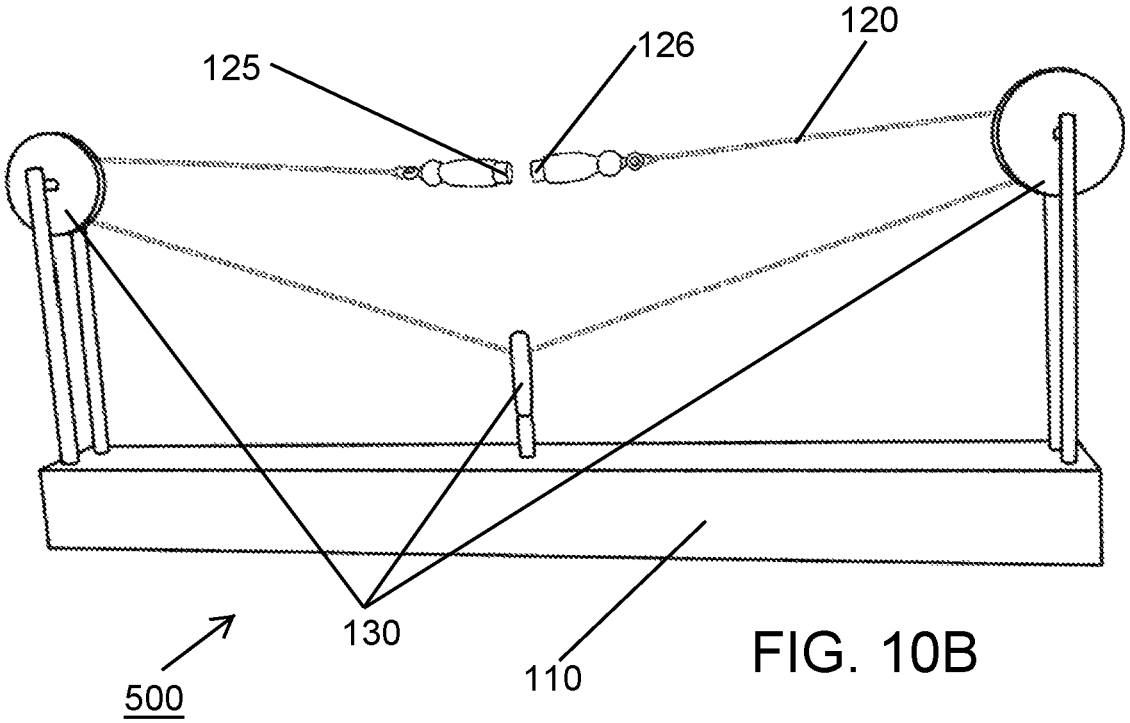

In another embodiment, such as those disclosed in FIGS. 10A-10B, a magnetic floating decorative device 300, 500 comprises a body 110 and a floating section 120. The floating section 120 comprises a first ferromagnetic-floating section 125 and a second ferromagnetic-floating section 126. The floating section 120 is flexible. The floating section is also connected to the body 110 at a connection point 130. In some embodiments, the floating section 120 may be connected to the body 110 at two or more connection points 130. The first ferromagnetic-floating section 125 is magnetically attracted to the second ferromagnetic-floating section 126.

In some embodiments, the first ferromagnetic-floating section 125 is magnetized. In other embodiments, the second ferromagnetic-floating section 126 is magnetized. In other embodiments, both the first ferromagnetic-floating section 125 and the second ferromagnetic-floating section 126 are magnetized.

The magnetic floating decorative device 100, 200, 300, 400, 500 is a decorative apparatus selected from wearable decorative devices and non-wearable decorative devices. The wearable decorative devices are jewelry selected from the group consisting of earrings, pendants, rings, bracelets, sarpeches, hatpins, hairpins, headpieces, carcanets, necklaces, armlets, cufflinks, hand chains, belly chains, brooches, chatelaines, and anklets.

An earring is a piece of jewelry attached to the ear via a piercing in the earlobe or another external part of the ear. Earring also includes clip earrings, which clip onto the earlobe or another external part of the ear. Earrings also include, but are not limited to, nose rings, nipple rings, navel rings, pendant earrings, and other body piercing jewelry.

A pendant is an aesthetic object that hangs from necklaces. Pendants also include, but are not limited to charms, amulets, dog tags, medals, medallions, lockets, and talismans.

A ring is a round band worn as an ornamental piece of jewelry around the finger or the toe. Rings include, but are not limited to, finger rings, toe rings, puzzle rings, fidget rings, and knuckle rings.

A bracelet is an article of jewelry that is worn around the wrist. Bracelets also include, but are not limited to bangles, friendship bracelets, gospel bracelets, and wrist watches.

A sarpech is a turban ornament, and is also known as an aigrette.

A hatpin is a decorative and functional pin for holding a hat to the head, usually by the hair.

A hairpin is a long device used to hold a person's hair in place.

A headpiece is an object worn on the head for decoration or protection. Headpieces also include, but are not limited to, metallic crowns, headbands, and tiaras.

A carcanet is an ornamental circlet for the hair, often of gold decorated with jewels or pearls. Carcanets also include, but are not limited to, temple rings.

A necklace is an article of jewelry which is worn around the neck. Necklaces also include, but are not limited to, chokers, torcs, bolo ties, prayer jewelry (for example, japa malas, prayer beads, prayer ropes and rosary beads), chains, and omega chains.

An armlet is an armband worn around the upper arm, and is also known as a brassard.

A cufflink is an item of jewelry that is used to secure the cuff of dress shirts.

A hand chain consists of a bracelet that attaches to a ring via a chain, bejeweled links, or other ornate hand connector along the back of the hand.

A belly chain is a type of body jewelry worn around the waist, and is also known as a waist chain. Some belly chains may attach to a navel piercing.

A brooch is a decorative jewelry item designed to be attached to garments. Brooches also include, but are not limited to, pins (for example, pledge pins, tie pins) and clips (for example, tie clips, shoe buckles).

A chatelaine is a decorative belt hook or clasp worn at the waist with a series of chains suspended from it.

An anklet is an ornament worn around the ankle, and is also known as an ankle chain, ankle bracelet, or ankle string.

Figure 6B:
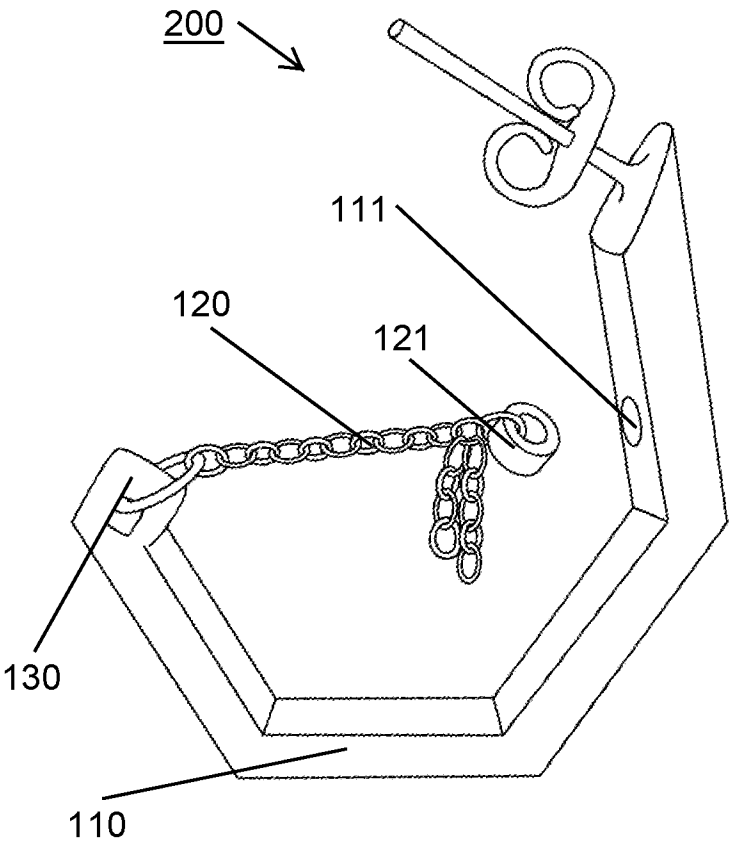
FIGS. 6A-6B are perspective views of embodiments of the present invention.
Figure 6A:
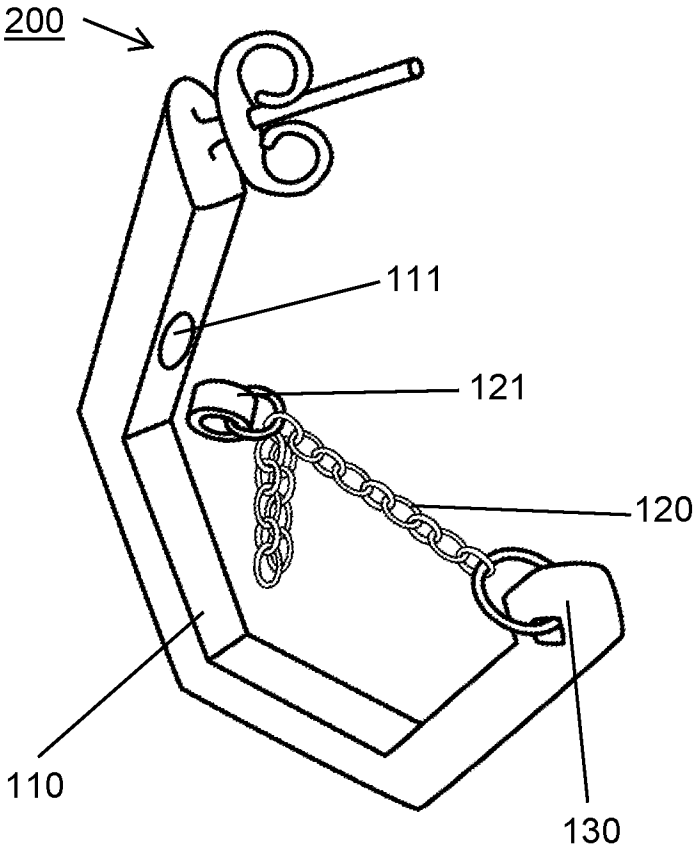
Figure 7B:
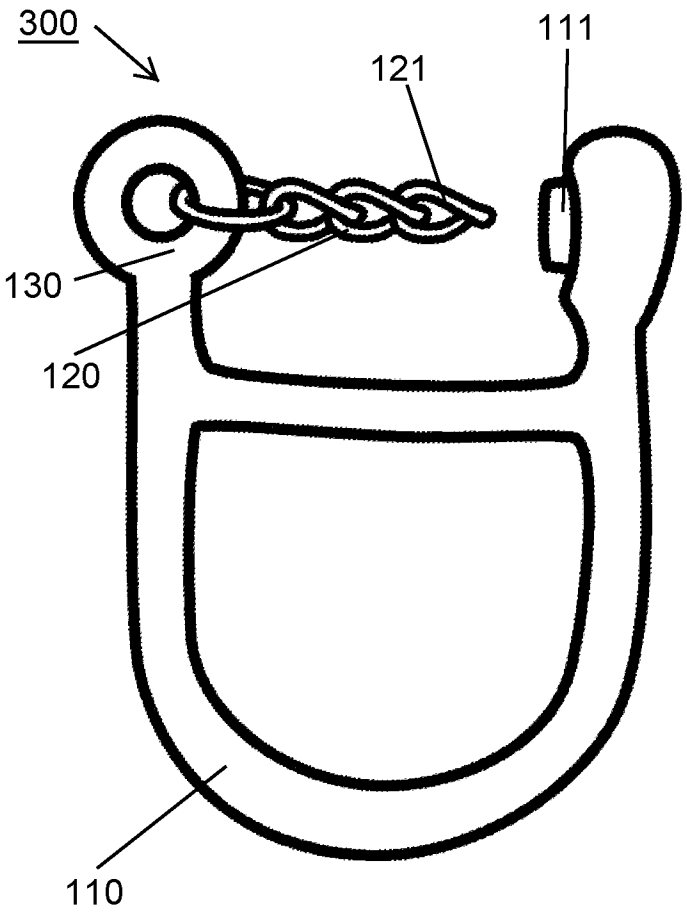
FIGS. 7A-7B are perspective views of embodiments of the present invention.
Figure 7A:
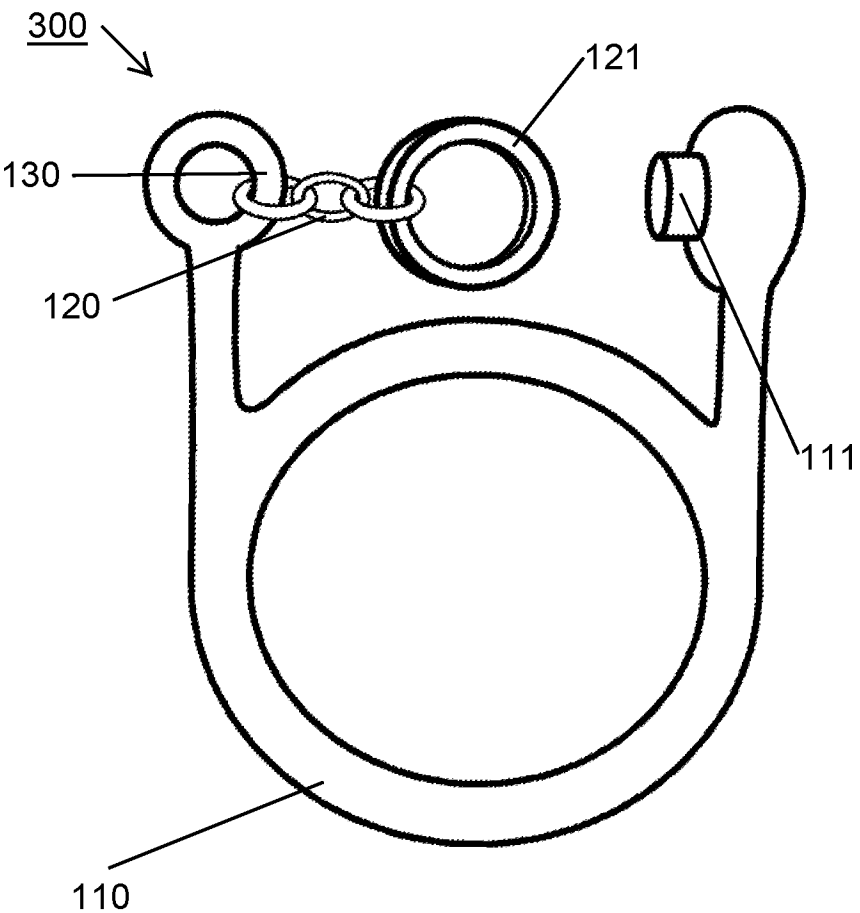

In some embodiments, the magnetic floating decorative device 200 is a wearable decorative device in the form of jewelry, such as an earring, examples of which are shown in FIGS. 6A-6B.

In other embodiments, the magnetic floating decorative device 100 is a wearable decorative device in the form of jewelry, such as a pendant, examples of which are shown in FIGS. 1A-1C, 2A-2C, 3A-3B, 4A-4B, and 5A-5C.

In some embodiments, the magnetic floating decorative device 300 is a wearable decorative device in the form of jewelry, such as a ring, examples of which are shown in FIGS. 7A-7B, 8A-8D, and 10A.

Figure 9:
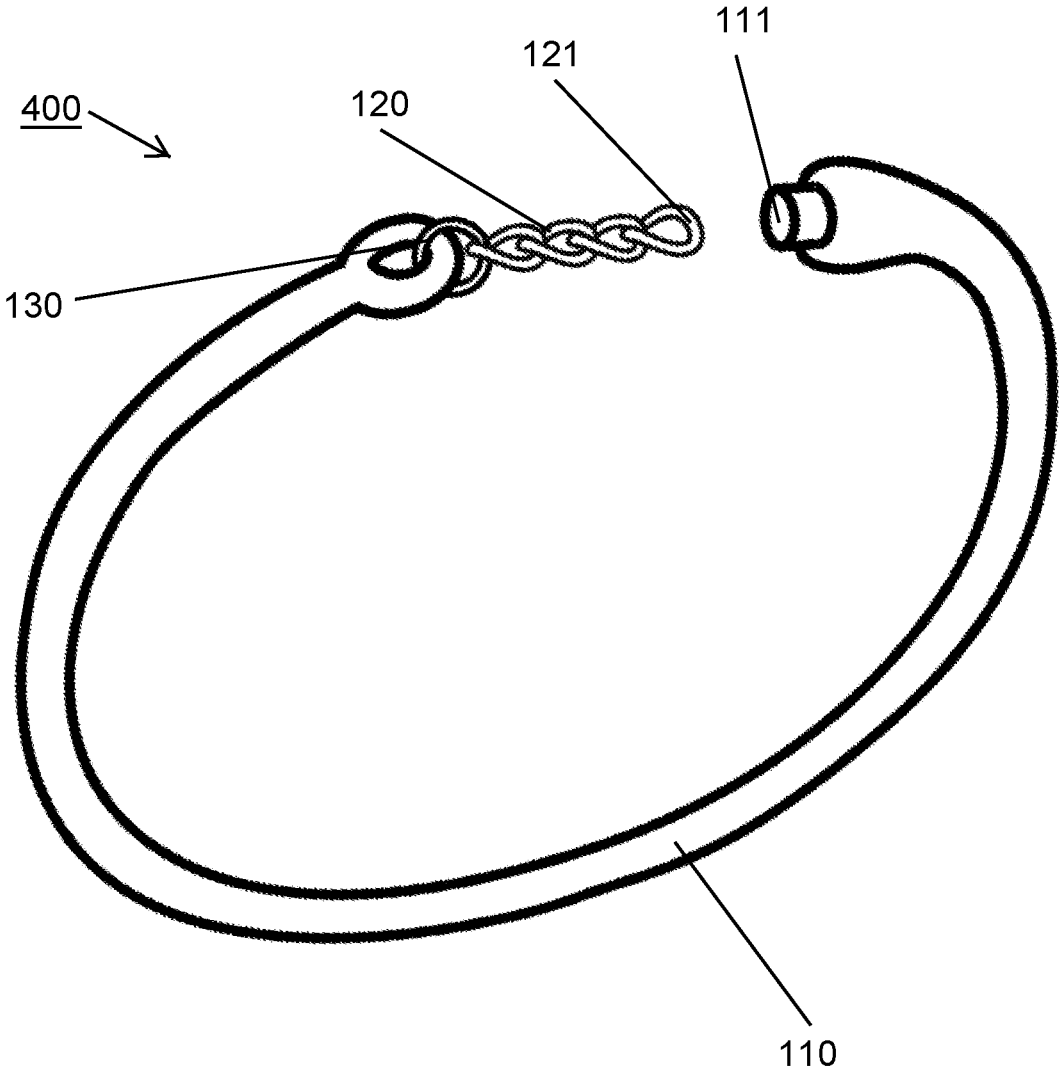
FIG. 9 is a perspective view of an embodiments of the present invention.

In other embodiments, the magnetic floating decorative device 400 is a wearable decorative device in the form of jewelry, such as a bracelet, an example of which is shown in FIG. 9.

In some embodiments, the magnetic floating decorative device 500 is non-wearable decorative device in the form of a sculpture, an example of which is shown in FIG. 10B.

As shown in the figures, the body 110 is not limited in shape, size or configuration. The body 110 may be shaped as pendants (see FIGS. 1A-1C, 2A-2C, 3A-3B, 4A-4B, and 5A-5C), earrings (see FIGS. 6A-6B), rings (see FIGS. 7A-7B, 8A-8D, and 10A), bracelets (see FIG. 9) and sculptures (see FIG. 10B). The present invention encompasses many different embodiments. For example, rings include, but are not limited to, those shown in the figures. For instance, FIG. 7A may be a finger ring or a toe ring, whereas FIG. 10A is a knuckle ring. Also, the body 110 and floating section 120 may be configured to allow may decorative variations; for instance, pendants may be open (see FIG. 2A), closed (see FIG. 2C), have moving parts that swivel (see FIG. 3B), allow different floating section 120 configurations (see FIGS. 5A-5C). Furthermore, the body 110 may be rigid, flexible, or a combination thereof. The body 110 is not limited to only one ferromagnetic-body section 111, as embodiments may include multiple ferromagnetic-body sections 111.

Figure 1A:
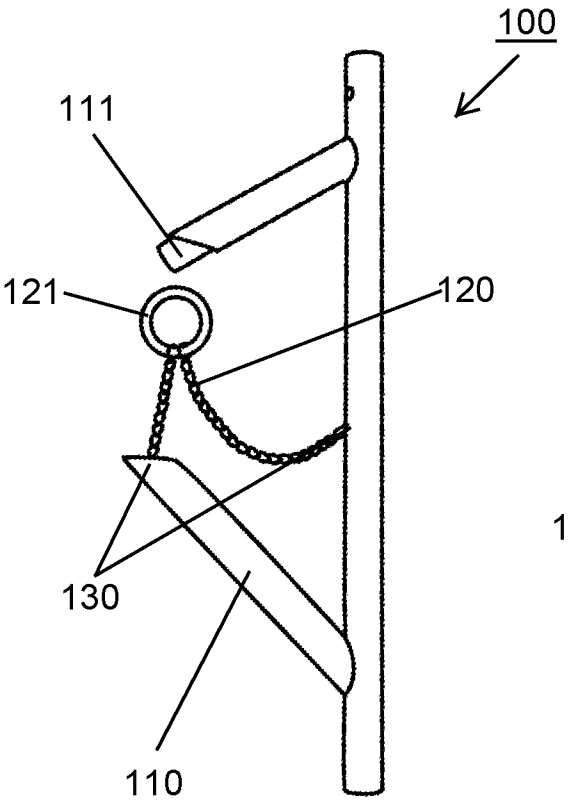
Figure 2C:
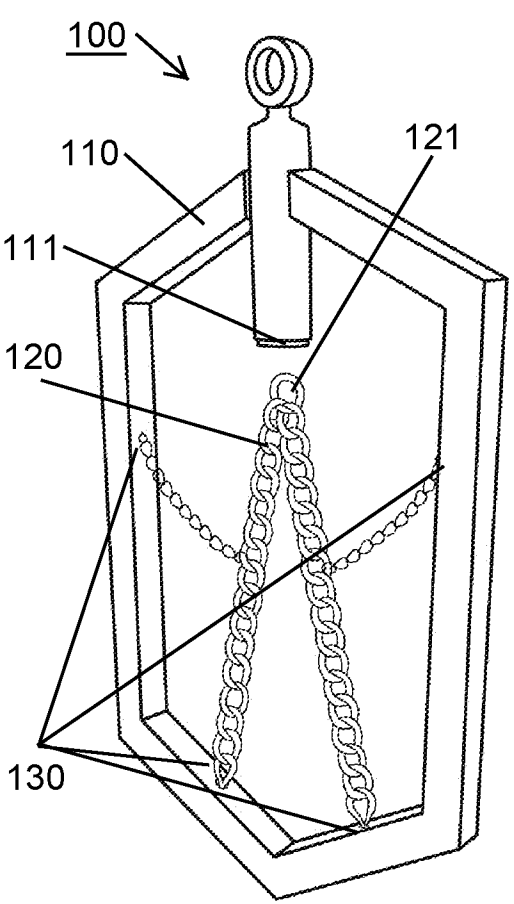
FIGS. 2A-2C are perspective views of embodiments of the present invention.
Figure 2B:
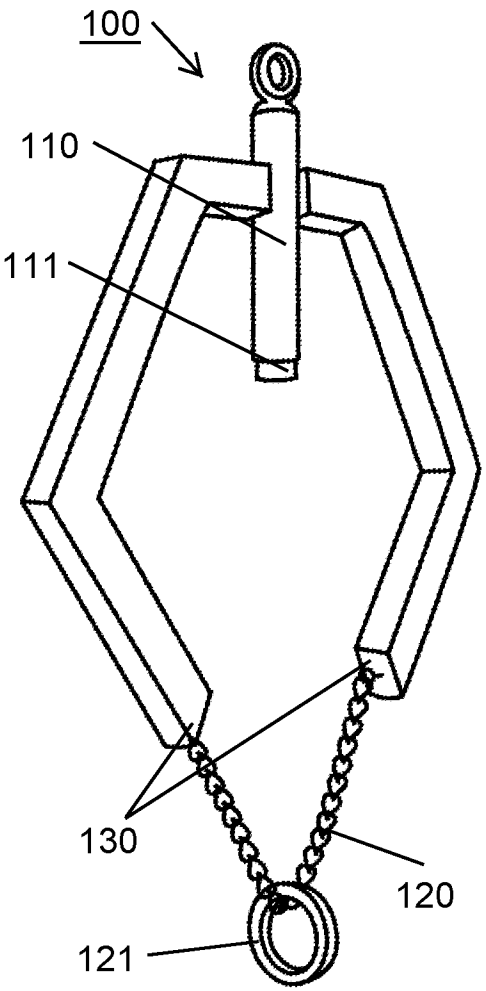
Figure 2A:
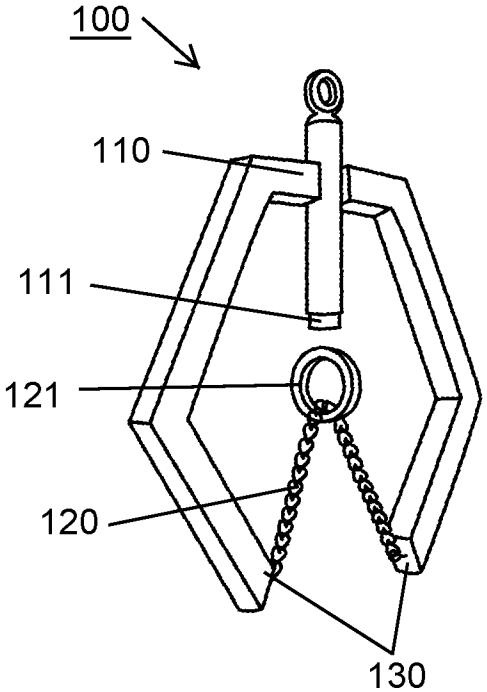
Figure 3B:
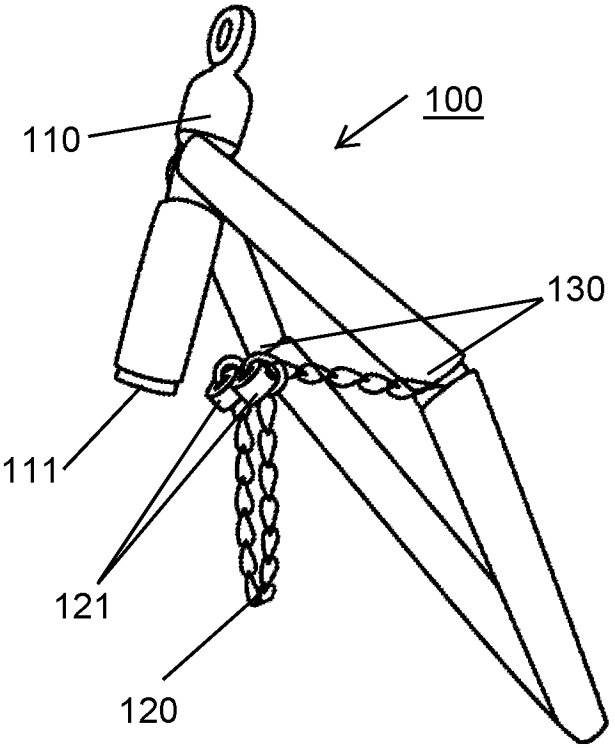
FIGS. 3A-3B are perspective views of embodiments of the present invention.
Figure 3A:
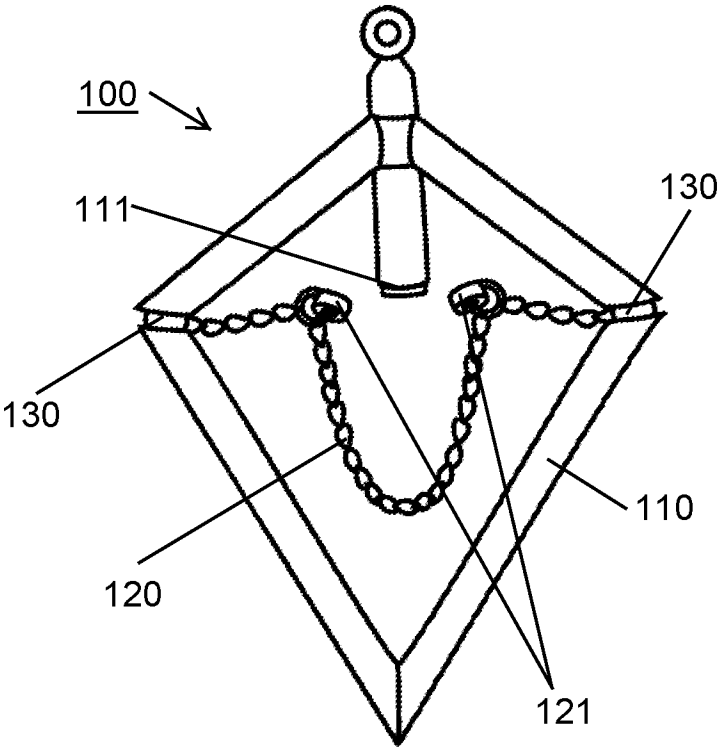
Figure 4A:
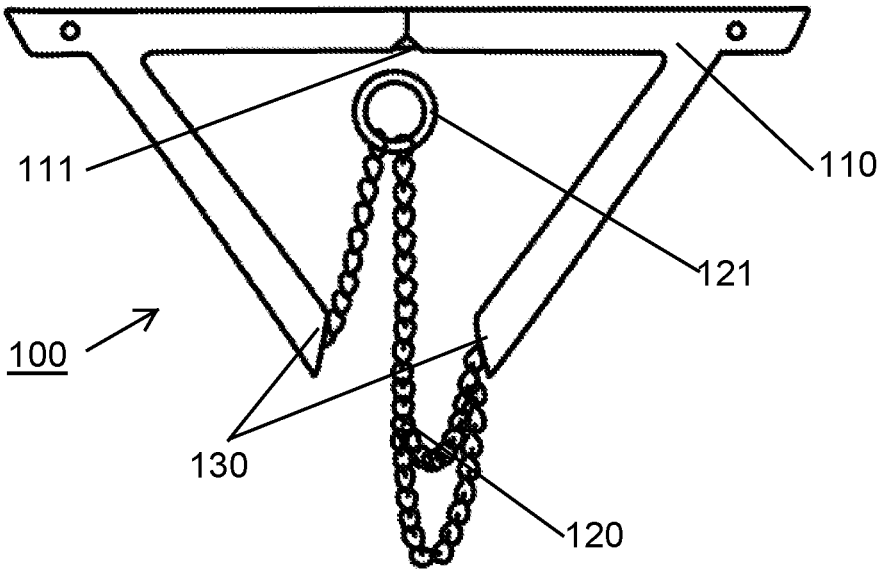
FIGS. 4A-4B are perspective views of embodiments of the present invention.
Figure 4B:
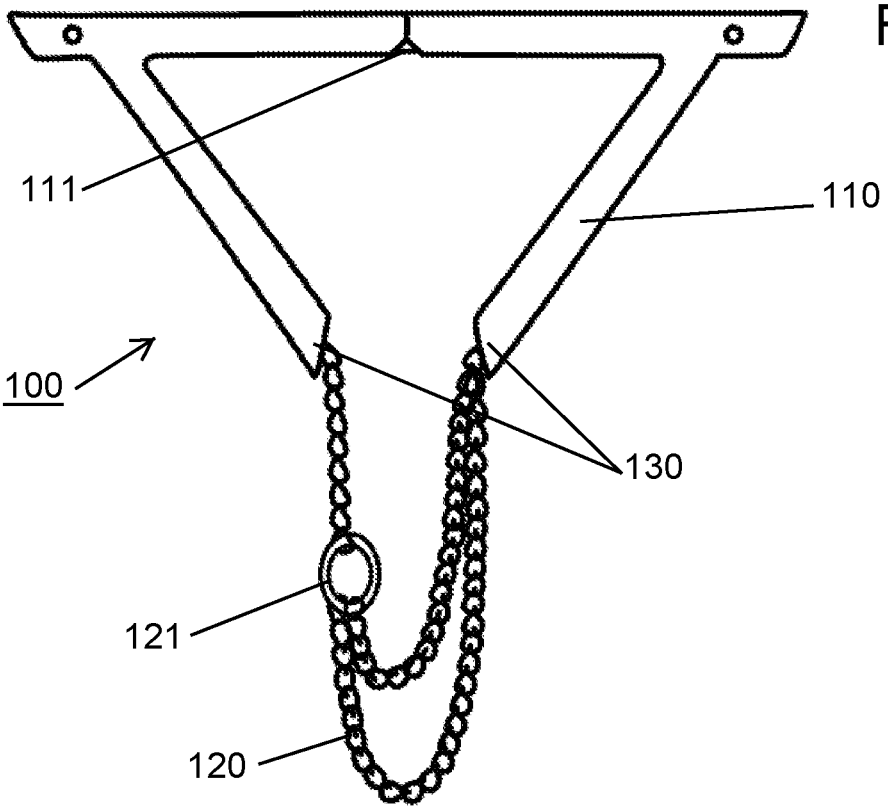
Figure 5C:
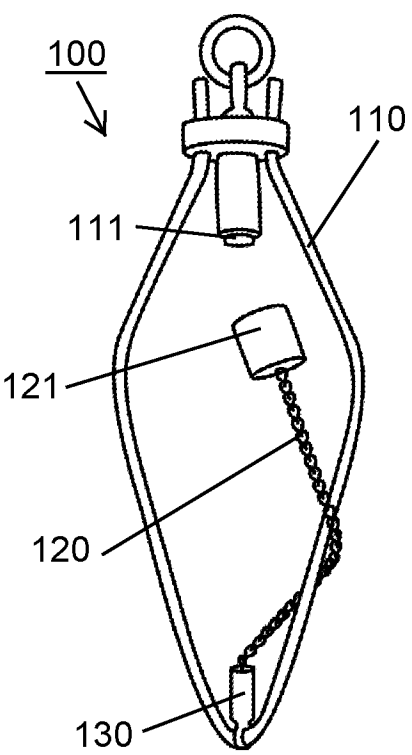
FIGS. 5A-5C are perspective views of embodiments of the present invention.
Figure 5B:
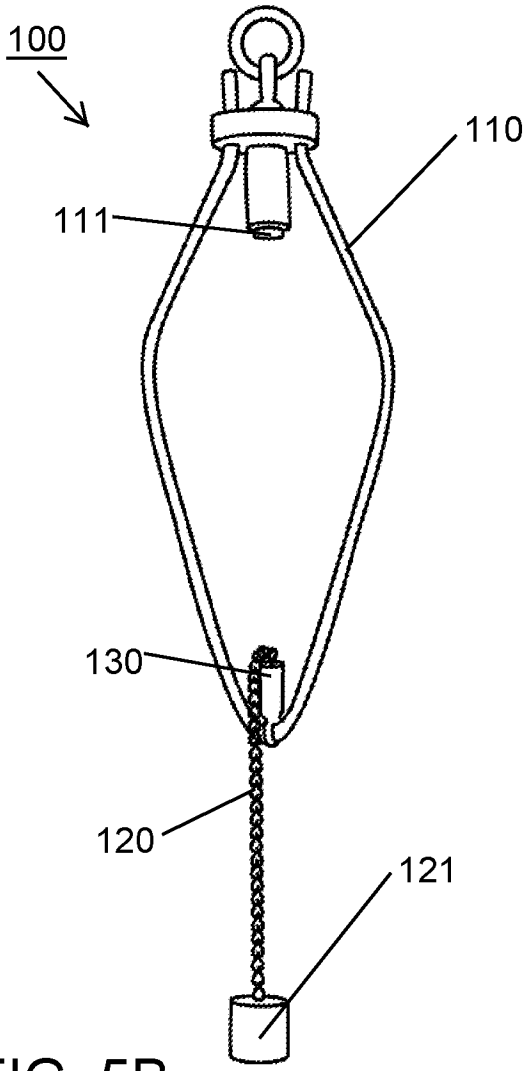
Figure 5A:
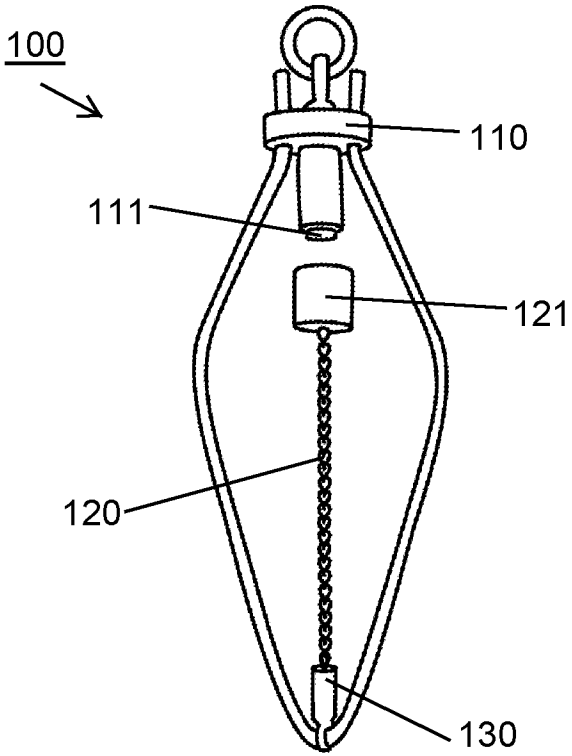
Figure 8A:
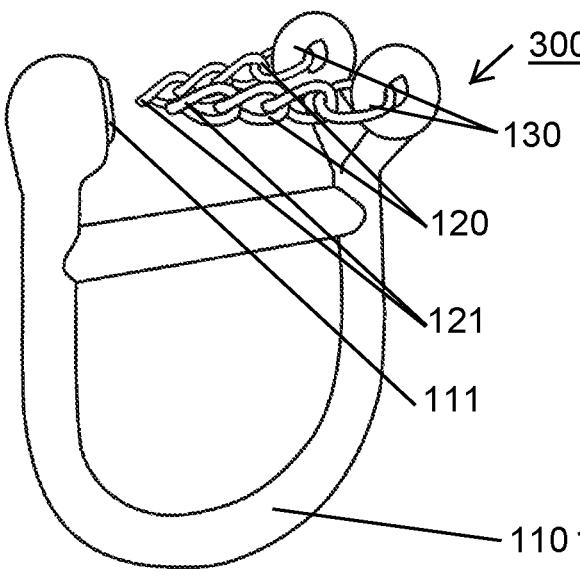
FIGS. 8A-8D are perspective views of embodiments of the present invention.
Figure 8B:
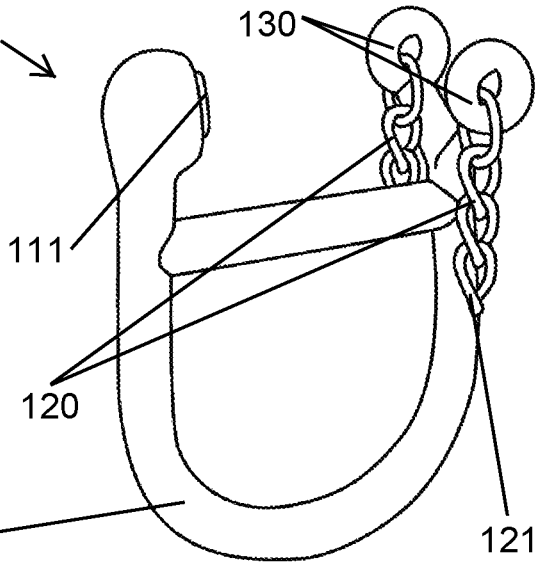
Figure 8C:
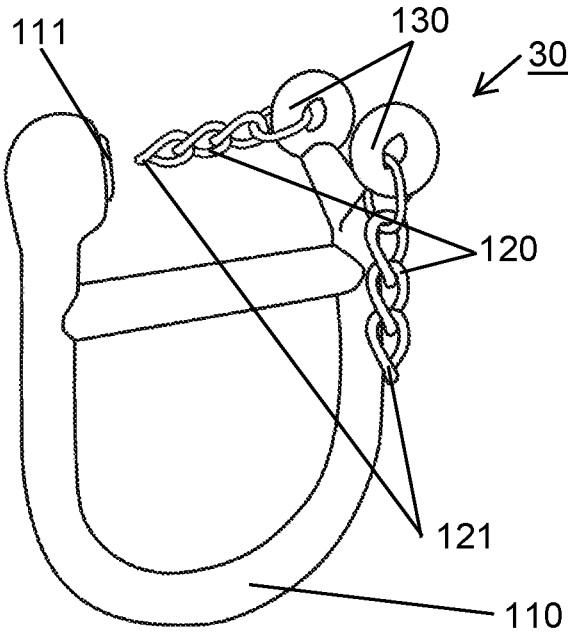
Figure 8D:
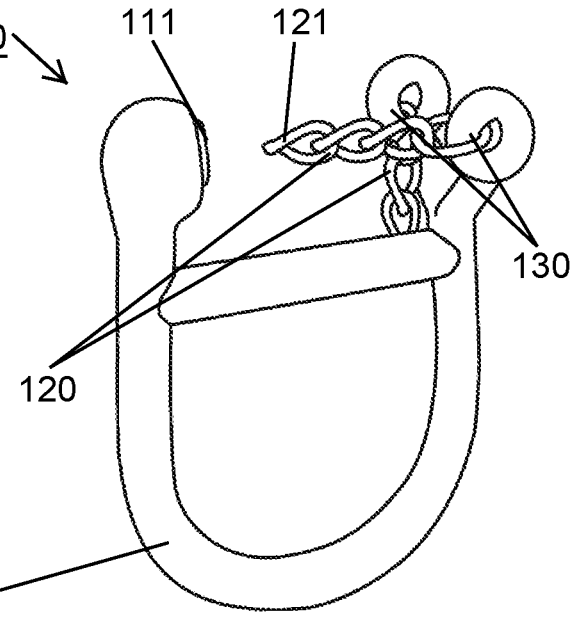

Similarly, the floating section is also not limited in shape, size or configuration. For example, FIG. 1A shows a floating section 120 that comprises a ring and two chains; FIG. 1C shows a floating section 120 that comprises a chain; FIG. 2C shows a floating section 120 that comprises three chains; FIG. 3A shows a floating section 120 that comprises a two rings and three chains; FIG. 4B shows a floating section 120 that comprises a ring and three chains; FIG. 5A shows a floating section 120 that comprises a cylinder and a chain; and, FIG. 8C shows a floating section 120 that comprises two chains. FIG. 8C also illustrates an embodiment with two floating sections 120. Furthermore, the floating section 120 may include a rigid section, a flexible section, or a combination thereof. The present invention is not limited to a floating section with chains, rings and cylinders. For instance, the floating section, may include types of chains not illustrated, rods, and spirals.

The floating section 120 is flexible to allow the floating section 120 to freely move toward the body 110, where the ferromagnetic-body section 111 and ferromagnetic-floating section 121 are in proximity to each other to allow magnetic attraction to create a floating or levitating effect, as shown, for example in FIG. 1A, as the ferromagnetic-body section 111 does not come into contact with the ferromagnetic-floating section 121. In an alternative decorative form, the ferromagnetic-body section 111 and ferromagnetic-floating section 121 are not in proximity to each other to allow magnetic attraction to create a floating or levitating effect, as shown, for example in FIG. 1B.

Similarly, in embodiments where the floating section 120 comprises a first ferromagnetic-floating section 125 and a second ferromagnetic-floating section 126, such as the embodiment shown in FIG. 1A, the first ferromagnetic-floating section 125 and the second ferromagnetic-floating section 126 are in proximity to each other to allow magnetic attraction to create a floating or levitating effect, as the first ferromagnetic-floating section 125 does not come into contact with the second ferromagnetic-floating section 126. If first ferromagnetic-floating section 125 and a second ferromagnetic-floating section 126 are not in proximity to each other, then no floating or levitating effect is created.

Ferromagnetic materials are strongly attracted to magnets, and are the only materials attracted to a magnet strongly enough to be commonly considered magnetic. Examples of ferromagnetic materials include, but are limited to, steel, iron, nickel, cobalt, gadolinium, alloys of rare-earth metals, naturally occurring minerals (for example, lodestone). The ferromagnetic-body section 111, ferromagnetic-floating section 121, first ferromagnetic-floating section 125, and second ferromagnetic-floating section 126 are comprised of ferromagnetic materials.

A magnet is a material or object that produces a magnetic field, which is a force that pulls on other ferromagnetic materials, such as iron, and attracts or repels other magnets.

I claim:

1. A magnetic floating decorative device comprising:
a body; and,
a floating section;
wherein the body comprises a ferromagnetic-body section;
wherein the floating section comprises a ferromagnetic-floating section;
wherein the floating section is flexible;
wherein the floating section is connected to the body at a connection point;
wherein the ferromagnetic-body section is magnetically attracted to the ferromagnetic-floating section;
wherein the device is a wearable decorative device; and,
wherein the wearable decorative device is jewelry selected from the group consisting of earrings, pendants, rings, bracelets, sarpeches, hatpins, hairpins, headpieces, carcanets, necklaces, armlets, cufflinks, hand chains, belly chains, brooches, chatelaines, and anklets.

2. The magnetic floating decorative device of claim 1, wherein the ferromagnetic-body section is magnetized.

3. The magnetic floating decorative device of claim 2, wherein the jewelry is an earring.

4. The magnetic floating decorative device of claim 2, wherein the jewelry is a pendant.

5. The magnetic floating decorative device of claim 2, wherein the jewelry is a ring.

6. The magnetic floating decorative device of claim 2, wherein the jewelry is a bracelet.

7. The magnetic floating decorative device of claim 1, wherein the ferromagnetic-floating section is magnetized.

8. The magnetic floating decorative device of claim 7, wherein the jewelry is an earring.

9. The magnetic floating decorative device of claim 7, wherein the jewelry is a pendant.

10. The magnetic floating decorative device of claim 7, wherein the jewelry is a ring.

11. The magnetic floating decorative device of claim 7, wherein the jewelry is a bracelet.

12. The magnetic floating decorative device of claim 1, wherein the ferromagnetic-body section is magnetized; and, wherein the ferromagnetic-floating section is magnetized.

13. The magnetic floating decorative device of claim 12, wherein the jewelry is an earring.

14. The magnetic floating decorative device of claim 12, wherein the jewelry is a pendant.

15. The magnetic floating decorative device of claim 12, wherein the jewelry is a ring.

16. The magnetic floating decorative device of claim 12, wherein the jewelry is a bracelet.

17. A magnetic floating decorative device comprising:
a body; and,
a floating section;
wherein the floating section comprises a first ferromagnetic-floating section and a second ferromagnetic-floating section;
wherein the floating section is flexible;
wherein the floating section is connected to the body at a connection point;
wherein the first ferromagnetic-floating section is magnetically attracted to the second ferromagnetic-floating section;
wherein the device is a wearable decorative device; and,
wherein the wearable decorative device is jewelry selected from the group consisting of earrings, pendants, rings, bracelets, sarpeches, hatpins, hairpins, headpieces, carcanets, necklaces, armlets, cufflinks, hand chains, belly chains, brooches, chatelaines, and anklets.

18. The magnetic floating decorative device of claim 17, wherein the first ferromagnetic-floating section is magnetized.

19. The magnetic floating decorative device of claim 18, wherein the jewelry is an earring.

20. The magnetic floating decorative device of claim 18, wherein the jewelry is a pendant.

21. The magnetic floating decorative device of claim 18, wherein the jewelry is a ring.

22. The magnetic floating decorative device of claim 18, wherein the jewelry is a bracelet.

23. The magnetic floating decorative device of claim 17, wherein the first ferromagnetic-floating section is magnetized; and, wherein the second ferromagnetic-floating section is magnetized.

24. The magnetic floating decorative device of claim 23, wherein the jewelry is an earring.

25. The magnetic floating decorative device of claim 23, wherein the jewelry is a pendant.

26. The magnetic floating decorative device of claim 23, wherein the jewelry is a ring.

27. The magnetic floating decorative device of claim 23, wherein the jewelry is a bracelet.

* * * * *